US006181902B1

(12) United States Patent
Kopp

(10) Patent No.: US 6,181,902 B1
(45) Date of Patent: Jan. 30, 2001

(54) METHOD FOR OPERATING AN ELECTROGRAPHIC PRINTER OR COPIER FOR PRINTING DIFFERENT COLORS WITH AT LEAST TWO DEVELOPING UNITS

(75) Inventor: Walter Kopp, Taufkirchen (DE)

(73) Assignee: Oce Printing Systems GmbH, Poing (DE)

( * ) Notice: Under 35 U.S.C. 154(b), the term of this patent shall be extended for 0 days.

(21) Appl. No.: 09/331,093

(22) PCT Filed: Dec. 17, 1997

(86) PCT No.: PCT/DE97/02954

§ 371 Date: Aug. 2, 1999

§ 102(e) Date: Aug. 2, 1999

(87) PCT Pub. No.: WO98/27472

PCT Pub. Date: Jun. 25, 1998

(30) Foreign Application Priority Data

Dec. 18, 1996 (DE) ..... 196 52 866

(51) Int. Cl.[7] ..... G03G 15/01

(52) U.S. Cl. ..... 399/228; 399/292; 399/293

(58) Field of Search ..... 399/228, 292, 399/293, 231, 232, 53, 55, 162

(56) References Cited

U.S. PATENT DOCUMENTS 4,777,106 10/1988 Fotland et al. ..... 399/292 X
5,270,782 12/1993 Floyd, Jr. ..... 399/281
5,630,200 * 5/1997 Christy ..... 399/228
5,666,599 * 9/1997 Miyasaka et al. ..... 399/162

FOREIGN PATENT DOCUMENTS 41 13 777 A1 1/1992 (DE) .
0 691 586 A1 1/1996 (EP) .
0 710 895 A1 5/1996 (EP) .

OTHER PUBLICATIONS

Japanese Abstract, 62049376, Publication Date: Apr. 3, 1987.

* cited by examiner

*Primary Examiner*—Arthur T. Grimley
*Assistant Examiner*—Hoan Tran
(74) *Attorney, Agent, or Firm*—Schiff Hardin & Waite

(57) ABSTRACT

A method for operating electrographic printers or copiers uses toner particles of two different colors applied to a toner image carrier by at least two developing units. A force field is applied to at least one section of the travel path of the toner particles from a toner container to the toner image carrier to cause the toner particles to be carried in the direction of the toner image carrier. Changing the force field causes an interruption of the transfer of the toner particles with the developer stations are in a rest position.

6 Claims, 4 Drawing Sheets

METHOD FOR OPERATING AN ELECTROGRAPHIC PRINTER OR COPIER FOR PRINTING DIFFERENT COLORS WITH AT LEAST TWO DEVELOPING UNITS

BACKGROUND OF THE INVENTION

1. Field of the Invention

The present invention relates to a method for operating an electrographic printer or copier in which toner particles of different colors are deposited onto a toner image carrier by at least two developer units.

2. Description of the Related Art

When the developer units in an electrographic printer have to develop two charge images with different colors in succession, where the regions to be developed in the two charge images have the same potential, one of the two developer units must be selectively switched into a transfer mode in which toner particles are deposited on the toner image carrier. The other developer unit, or respectively, the other developer units must be in a resting state in which no toner particles are deposited on the toner image carrier. It must be guaranteed that a developer unit deposits toner particles onto the charge image only when the charge image is to be developed with toner particles of this developer unit. It is therefore necessary that the developer units with toner particle of a color that is not needed remain in the resting state when the charge image is moved past them. This is true regardless of whether the charge image has already been developed with toner particles or it will be developed with toner particles at a subsequent developer unit. The toner image carrier is a photoconductor, for example, from which the toner image is directly or indirectly transferred, via a transfer band, onto a final image carrier, such as paper.

A known solution according to a first embodiment in European Patent Document EP 0 691 586 A1 provides that the developer units are swivelled away from the toner image carrier in the resting state, in order to prevent a transfer of toner particles of the wrong color. This method is disadvantageous in that the developer units must be swivelled relatively far away in order to switch over from the transfer state to the resting state. Accordingly, in the changeover from the resting state into the transfer state, the developer units must be swivelled relatively far again back to the toner image carrier. The changeover thus cannot be executed arbitrarily rapidly. Besides, the motorized swivelling of the developer units is only possible with a plurality of additional mechanical components, which are subjected to heavy wear. Often, in addition to swivelling, other measures must be taken, such as an activation and deactivation of rotating components in the developer unit, in order to prevent a dusting or undesired spreading of the toner. This dust would lead to undesirable background formations on the toner image carrier and to contamination of the printer. The activation and deactivation of the rotating components further prolongs the time for the changeover. The European Patent Document EP 0 691 586 A1 also describes a second embodiment, in which a force field in the development gap is activated, or respectively, deactivated in order to switch on, or respectively, switch off the developer unit.

In a developer unit according to U.S. Pat. No. 5,270,782, in the off state of the developer unit, the toner particles on the developer roll are removed by means which are not further detailed.

The above described problems arise in electrographic, magnetographic and ionographic printers or copiers, among others, which fall under the heading of electrographic printers. The toner used is either a single-component or multi-component toner. Solid or liquid toners may be used.

According to German Patent Document DE 4113 777 A1, charge regions of equal potential can be developed with toner particles of different colors if an exposure unit is allocated to each developer unit. A developer unit does not develop if the allocated exposure unit is switched to dark. The above problems with respect to the activation and deactivation of the developer units do not arise. However, for this, a plurality of exposure units must be installed in the printer, which units require space and which entail expensive manufacturing technology.

SUMMARY OF THE INVENTION

It is an object of the invention to propose an additional, simple method for operating an electrographic printer or copier, which method permits a rapid activation and deactivation of the developing power of the developer units.

This object is achieved by a method for operating an electrographic printer or copier, in which toner particles of different colors are deposited on a toner image carrier by at least two developer units, one of the two developer units being selectively switched into a transfer state in which toner particles are deposited onto the toner image carrier, the other developer unit being in a resting state in which no toner particles are deposited onto the toner image carrier, a force field being applied to at least one segment of the transport path of the toner particles from a toner container to the toner image carrier in the transfer state of the developer unit, the force field effecting the transport of the toner particles in the direction of the toner image carrier, and the transport of the toner particles is interrupted at the segment by the altering of the force field in the resting state of the developer unit, the force field acting in the region of a toner particle stock contained in the toner container, and/or the force field acting in the region of a transfer gap of a transport mechanism which transports the toner particles to be applied, subsequent to removal from the toner container, to a development gap between the toner image carrier and a delivery element for delivering toner particles from the developer unit. Advantageous developments of the invention are provided by the force field being altered by reversing the polarity or by switching off an electrical supply voltage for the buildup of the force field. Further, an additional force field may be provided acting in the region of a development gap between the toner image carrier and a delivery element for delivering toner particles from the developer unit. In one embodiment, a toner image carrier onto which toner particles of different colors are deposited by at least two developer units, a control unit which selectively switches one of the two developer units into a transfer state in which toner particles are deposited onto the toner image carrier, the other developer unit is in a resting state in which no toner particles are deposited on the toner image carrier, and at least one field generator for each developer unit, whose force field acts on a segment of the transport path of the toner particles from the toner container to the toner image carrier, the control unit switches the force field in the transfer state such that the force field effects the transport of the toner particles in the direction of the toner image carrier, and the control unit switches the force field in the resting state such that the transport of the toner particles is interrupted at the segment, at least one of the developer units contains the following elements: a device for creating a mixture of air and toner particles in the toner container, which mixture behaves like a fluid, a corona means with a predetermined potential for the electrical charging of the toner particles, and a toner accepting surface, which is arranged opposite the corona device and onto which the charged toner particles settle under the influence of the force field, and/or at least one of the developer units contains a transport device for transporting the charged toner particles, the transport device transporting the charged toner particles, subsequent to removal from the toner container, in the direction of a delivery for delivering the toner particles from the developer unit, and a force field is arranged inside the transport device.

As a further development, the toner particles are transported using at least one rotating surface which rotates with a prescribed speed in the transfer state and in the resting state. The force field may be generated between opposed conductive surfaces or surface portions that have a potential difference of a specified size, which difference is reduced and/or altered in its sign in the resting state as compared to the operative state.

The invention is based on the recognition that, in order to achieve a short activation time, or respectively, deactivation time of the developing power of the developer units, a movement of mechanical components must be avoided. If all mechanical components of the developer unit, as well as the developer unit itself remain always in the same position, then there must occur an engagement into the transport path of the toner particles.

In the transfer state of the respective developer unit, a force field is inventively applied in at least one portion of the transport path of the toner particles from a toner container to the toner image carrier, the force field effecting the transport of the toner particles in the direction of the toner image carrier. In the resting state of the respective developer unit, the transport of the toner particles to the segment is interrupted by a changing of the force field. Thus, on the basis of the effect on a segment, which is relatively small compared to the total transport path of the toner particles, the respective developer unit is inventively in the transfer state, when toner particles are being transported through the segment, or the developer unit is in the resting state, when no toner particles are being transported through the segment. Since the segment can be selected to be small, the outlay for influencing the segment is inventively low.

Furthermore, mechanical components do not have to be set in motion in order to influence the segment, since the force field can be changed via the energy supply.

According to the invention, the developer unit does not deliver toner particles in the resting state, since the toner particles are held back at the segment. This prevents an undesirable background formation on the toner particle image.

In the invention, the force field for interrupting, or respectively, enabling the toner particle transport is arranged at a point in the transport path of the toner particles that is located outside the development gap. If the variable force field acts in the region of the toner container, then the influenced segment is situated at the beginning of the transport path of the toner particles from the toner container to the toner image carrier. In the resting state, the transport of toner particles along the transport path is not even begun, so that means for transport can likewise be switched into a resting state.

Alternatively, the force field inventively acts in the region of the transport apparatus which transport the toner to be applied, subsequent to removal from the toner container. The segment for influencing the development power of the developer unit is located in the center part of the transport path in this case. An influencing of a force field at the toner image carrier or of a force field for removing the toner particles from the toner container is avoided, and the changeover time is between the changeover time given the situating of the segment at the beginning of the transport path and the changeover time given the situating of the segment at the end of the transport path. The transport path can also be interrupted in several places.

In an exemplifying embodiment of the invention, the force field is altered by reversing the polarity or by switching off the electrical supply voltage for building the force field. Both polarity reversal and cut-off are easy to realize technically. On the basis of a polarity reversal, the force field even counteracts the transport of the toner particles in the direction of the charge image carrier at the segment. The segment can thus be further shortened compared to the length required for simple cut-off.

Another aspect of the invention relates to an electrographic printer or copier which is used particularly for executing the inventive method. The above-mentioned technical effects thus also occur in the printer or copier.

The effects of the invention come to bear particularly when the toner particles used in the developer unit of the electrographic printer have been extracted from a toner-air mixture, as is described in U.S. Pat. No. 4,777,106.

BRIEF DESCRIPTION OF THE DRAWINGS

Exemplifying embodiments of the invention are detailed below with reference to the drawings.

DETAILED DESCRIPTION OF THE PREFERRED EMBODIMENTS

Figure 1:
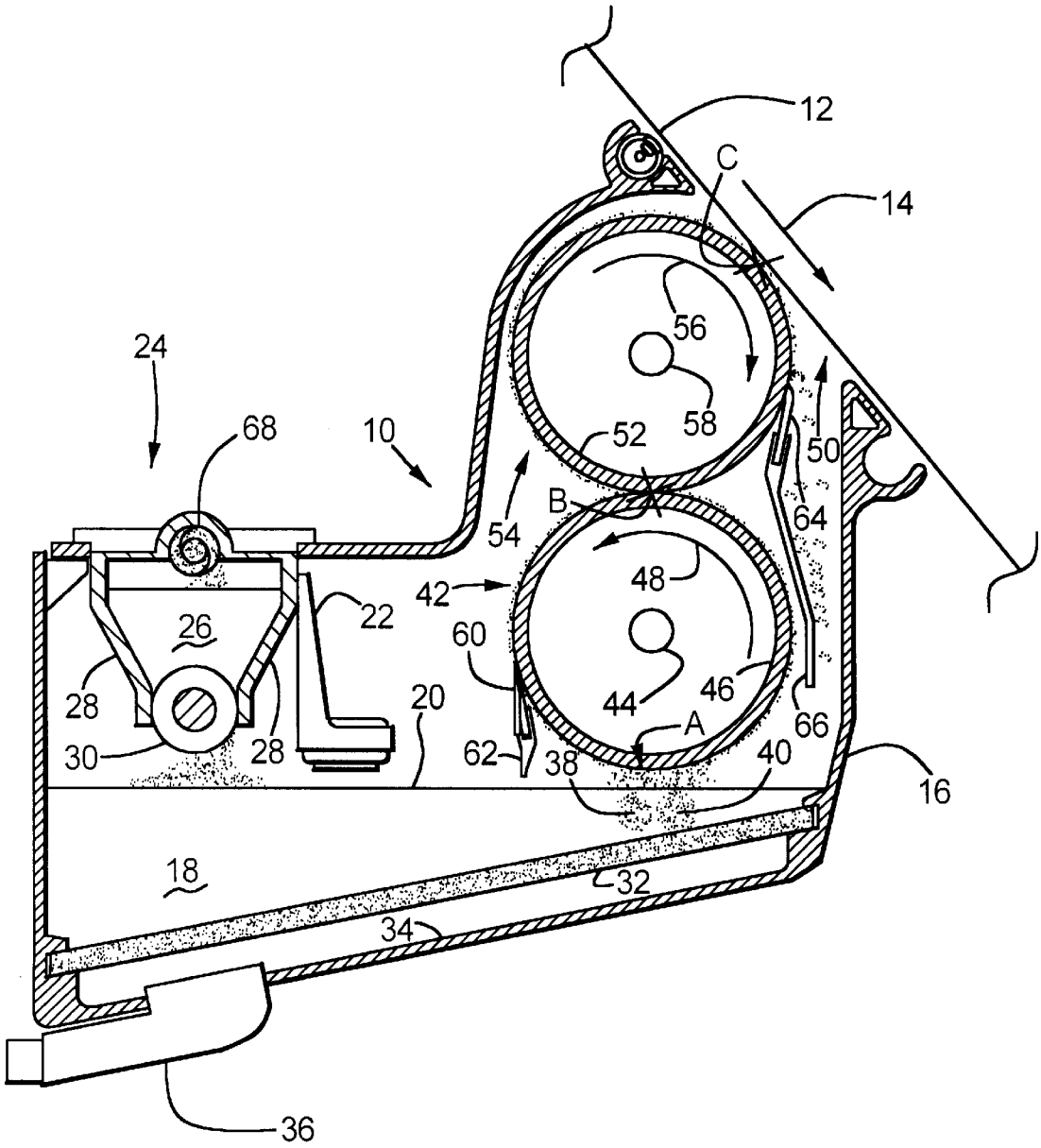
FIG. 1 is a side cross sectional view showing the schematic construction of a developer unit.

FIG. 1 is a schematic illustration of the construction of a developer unit 10, past which a photoconductor band 12 is moved in the direction of an arrow 14. On the photoconductor band 12, in the surface region facing the developer unit 10, there is a latent charge image in which the charges are distributed according to the image information of the image to be printed. The transport mechanism for the photoconductor band 12 has not been included in FIG. 1 for the sake of simplifying the illustration.

The developer unit 10 contains a container 16 in which a toner-air mixture 18 is located. In the mixture 18, toner and air are mixed approximately in a ratio of 1:10, whereby the mixture 18 acts like a fluid. A boundary surface 20 between the mixture 18 and the air contained in the developer unit 10 is relatively smooth. An ultrasound sensor 22 above the surface 20 defects a fill level h of the mixture 18.

The mixture 18 is generated from solid toner particles with an average size of approximately 10 $\mu$m, which are added to the toner-air mixture 18 in defined amounts by a toner dosing means 24. There is a toner particle stock 26 between inclined sidewalls 28 of the toner dosing means 24, so that the toner particles are fed to a dosing wheel 30 in a funnel-shaped manner. The dosing wheel 30 has recesses along its perimeter, into which equal amounts of toner particles are respectively deposited. Due to a rotation of the dosing wheel 30, toner particles are fed from the interior of the toner dosing means 24 to the toner-air mixture 18 as soon as the ultrasound sensor 22 registers a sinking of the boundary surface 20 below a prescribed target level.

In the floor region of the developer unit 10, an air-permeable plate 32 made of porous polyethylene material is arranged, through which air flows, over a large area, from a chamber 34 situated beneath the plate 32 into the toner-air mixture. The chamber 34 is continuously fed air through an air supply terminal 36.

In the developer unit 10 there are two corona wires 38 and 40, which have a voltage of approximately −8 kV and which negatively charge the toner particles of the mixture 18 in their environment. The corona wires 38 and 40 run transversely through the entire developer unit in a length that approximately corresponds to the reach of the photoconductor band 12 transversely to its transport means 14. Above the corona wires 38 and 40 and above the boundary surface 20, a transfer roller 42 is arranged, whose axle 44 extends parallel to the corona wires 38 and 40. A conductive surface layer 46 has a potential of approximately −0.9 kV, so that the generated negative toner particles are deposited on the surface layer 46 over the entire length of the corona wires 38 and 40, on the basis of the effect of the electrical field between the corona wires 38 and 40 and the transfer roll 42. Given a rotation of the transfer roll 42 in the direction of an arrow 48, the deposited toner particles are transported in the direction of an opening 50 of the developer unit 10 for toner particle delivery. For the section illustrated in FIG. 1, the transport path of the charged toner particles runs through the developer unit 10 along the outer radius of the transfer roll 42, from a point A to a point B.

At point B, the toner particles are transferred, under the influence of an additional electrical field, to a conductive surface layer 52 of a developer roller 54, which rotates in the direction of the arrow 56. The additional electrical field is situated between the surface layer 46 and the surface layer 52, which is charged to a potential of approximately −0.5 kV. The axle 58 of the developer roll 54 is arranged essentially parallel to the axle 44. For the section illustrated in FIG. 1, subsequent to the transfer in point B, the toner particles are transported by the developer roll 54 along the outer radius of the developer roll 54 to a point C in the opening 50.

Individual toner particles which were not transferred to the developer roll 54 by the transfer roll 42 are removed from the surface layer 46 with the aid of a stripper 60, before the respective region of the surface layer 46 is again covered with new charged toner particles. The stripper 60 extends over the entire length of the transfer roll 42 and is held by a stripper retainer 62.

In the region of the opening 50, the latent charge image of the photoconductor band 12 is developed in that, in charged regions of the photoconductor band 12, toner particles from the surface layer 52 settle down. Toner particles which remain on the developer roll 54 are removed from the surface layer by another stripper 64 before new toner particles are again deposited by the transfer roll 42. The stripper 64 extends over the entire length of the developer roll 54 and is held by another stripper retainer 66, which is also a conducting mechanism of the toner particles escaping from the developer roll 54. The toner particles which are removed by the strippers 60 and 64 fall back into the mixture 18.

By a toner supply means 68, the developer unit is fed toner to replace the toner particles used in the developing.

Figure 2:
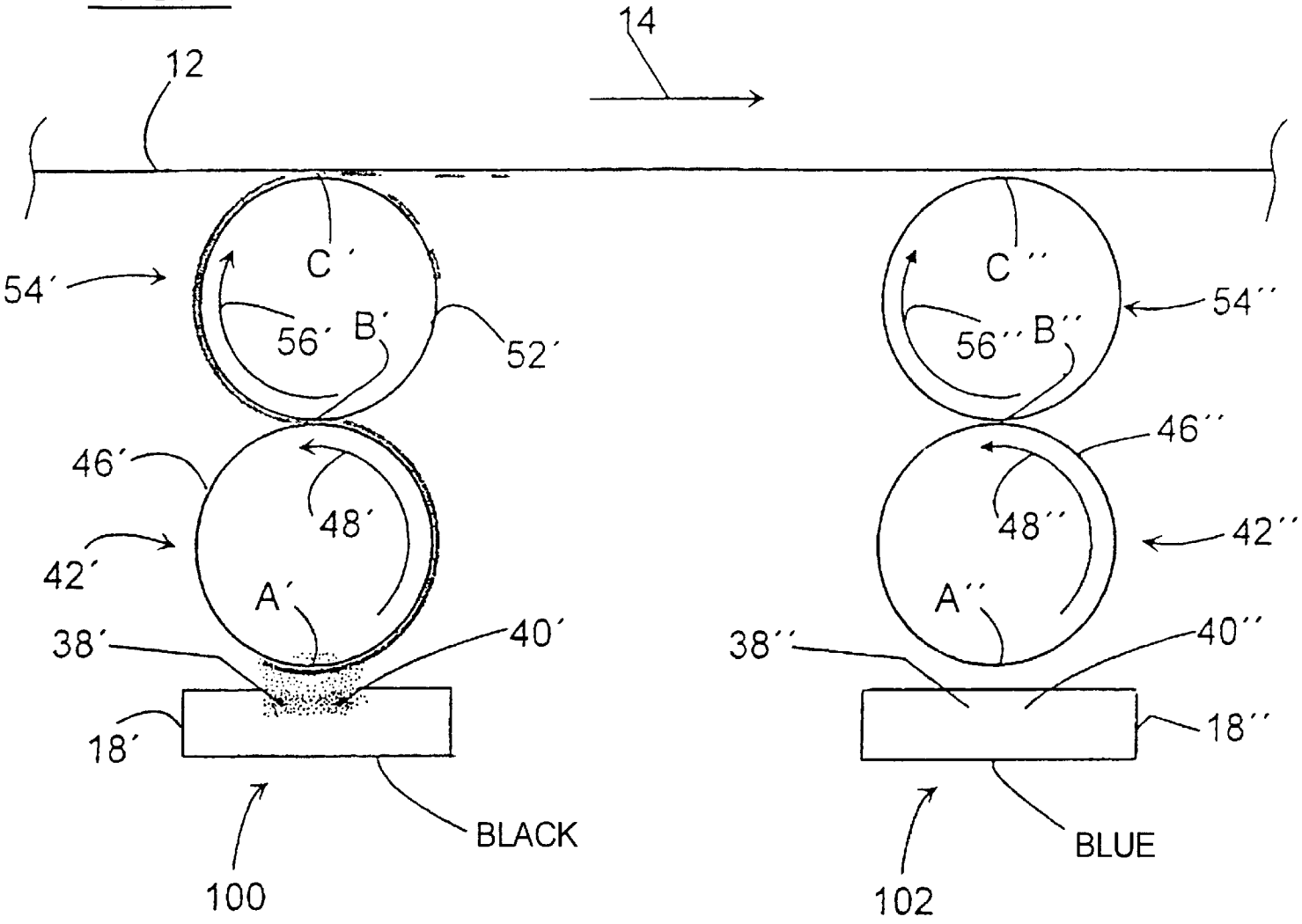
FIG. 2 is a side view showing the arrangement of two developer units at a photoconductor band.

FIG. 2 illustrates the arrangement of two developer units 100 and 102 at the photoconductor band 12, though only the required components are illustrated. The developer units 100 and 102 are constructed like the developer unit 10, and identical components are not described again. These components retain their reference characters, and are characterized by one apostrophe, in the case of the developer unit 100, and by two apostrophes, in the case of the developer unit 102. The toner particles in the toner-air mixture 18' have the color black, so that the developer unit 100 can develop a latent charge image on the photoconductor 12 only with black toner particles. On the other hand, the toner particles in the toner-air mixture 18" have the color blue, so that, in the transfer state, the developer unit 102 develops the latent charge image on the photoconductor band 12 with toner particles of the color blue.

In FIG. 2, the developer unit 100 is in the transfer state, while the developer unit 102 is in a resting state in which no blue toner particles are deposited on the photoconductor band 12.

Charge images are deposited on the photoconductor band 12 in succession, these being selectively developed by the developer unit 100 or the developer unit 102. The toner images are subsequently transferred from the photoconductor band 12 onto a final image carrier such as paper with the aid of a transfer device (not illustrated), the print images being printed adjacent to one another on one final image carrier, or on different final image carriers.

Alternatively, the toner images can be printed over one another on one final image carrier. To this end, either the final image carrier is moved past the transfer device multiple times, or an intermediate carrier is used, on which the print images are "collected" until their ultimate transfer from the intermediate carrier onto the final image carrier in another transfer process.

FIG. 2 illustrates a momentary state in which the developer unit 100 is in the transfer state and the developer unit 102 is in the resting state. Thus, black toner particles are used for developing the latent charge image on the photoconductor band 12, exclusively. When the developed charge image moves past the developer unit 102, no blue toner particles are deposited, since the developer station 102 is in the resting state. The generation of the resting state is detailed later.

When it is necessary to deposit blue toner particles onto the latent charge image of the photoconductor band 12, then the developer unit 100 is switched from the transfer state into the resting state by a control unit (not illustrated), and the developer unit 102 is likewise switched from the resting state into the transfer state by the control unit. In this case, given the transport of the latent charge image on the photoconductor band 12 past the developer unit 100, black toner particles are not deposited. The latent charge image reaches the developer unit 102 undeveloped, by which unit the blue toner particles are then deposited.

In FIG. 2, the developer unit 102 is in the resting state, since an electrical force field between the corona wires 38" and 40" and the surface layer 46" of the transfer roll 42" has been deactivated, so that no toner particles are removed from the toner-air mixture 18". The transfer roll 42" and the developer roll 52" of the developer unit 102 rotate in the resting state as well, in order to avoid setting a target rotation rate when the developer unit 102 is switched into the transfer state again. The setting of the target rotation rate requires a longer response time, which delays the changeover unnecessarily.

Figure 3A:
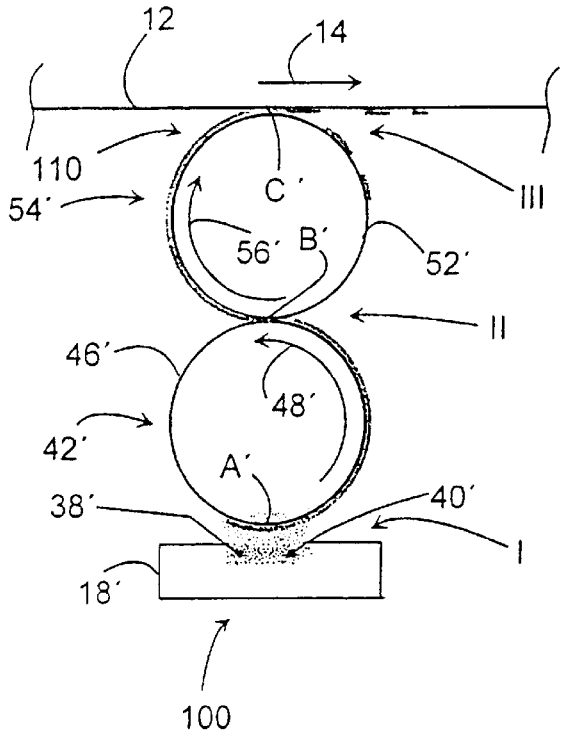
FIG. 3A is a side view and FIGS. 3B and 3C are enlarged side views showing the processes at three force fields within the developer unit.
Figure 3B:
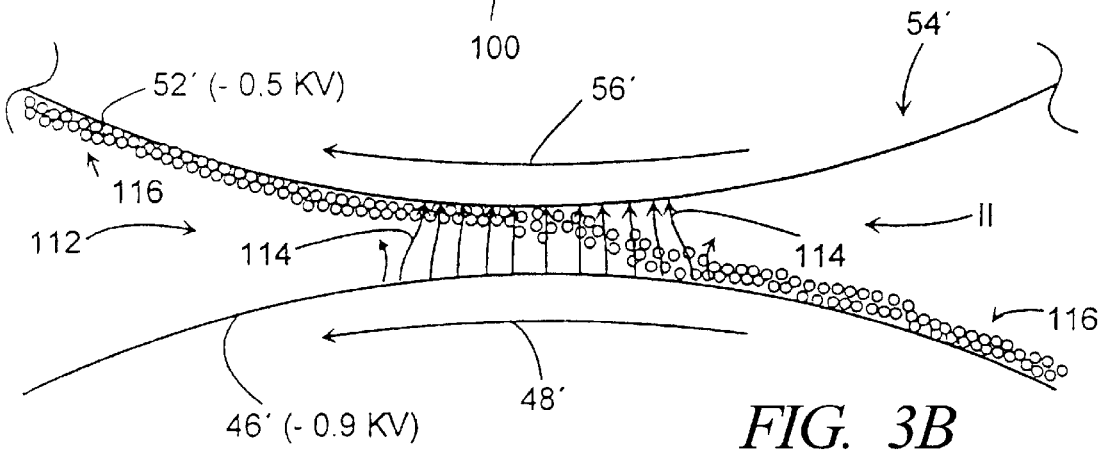
Figure 3C:
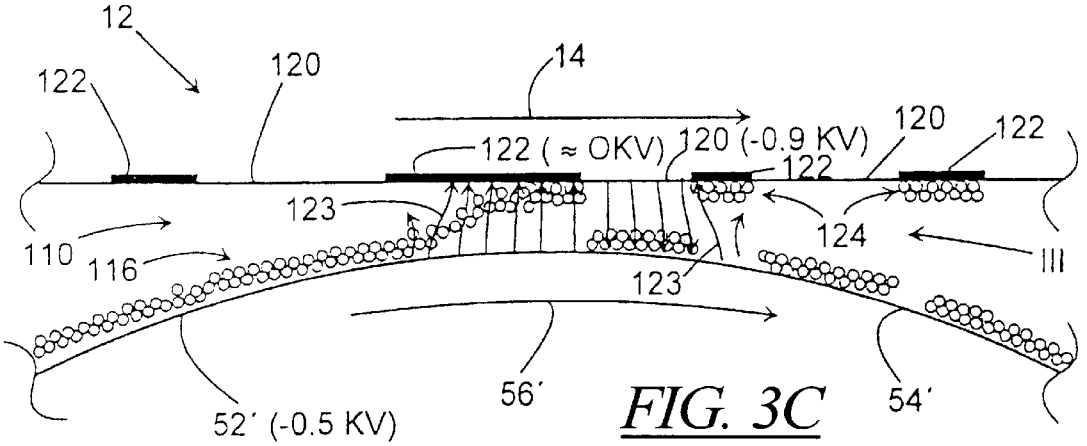

FIGS. 3A, 3B and 3C illustrate processes at the three force fields within the developer unit 100. FIG. 3A illustrates the previously detailed developer unit 100 in a schematic view. The first force field I acts between the corona wires 38' and 40' and the surface layer 46' of the transfer roll 42' in the region of the point A'.

The second electrical force field II acts between the surface layer 46' and the surface layer 52' of the developer roll 54' in the region of the point B'. The third force field III acts in the region of a development gap 110 between surface layer 52' and photoconductor band 12.

By the first force field I, toner particles from the toner-air mixture 18 are deposited onto the surface layer 46'.

FIG. 3B shows an enlarged view of the force field II in the transfer state. Between the surface layer 46', which is charged to a potential of −0.9 kV, and the surface layer 52', which is charged to a potential of −0.5 kV, an electrical field forms in a transfer gap 112, the lines of this field extending from the surface layer 52' to the surface layer 46'. For the sake of simplicity, force field lines 114 are illustrated in the transfer gap 112 in FIG. 3B instead of the field lines, which force field lines 114 make clear the forces in the transfer gap on negatively charged toner particles 116. Due to the negative charge of the toner particles 116, the force lines 114 run against the field lines from the surface layer 46' to the surface layer 52'. The toner particles 116 are thus transferred in the transfer gap 112 by the force field II from the transfer roll 42' to the developer roll 54'. Since both rolls 42', or respectively, 54' rotate synchronously in the direction of the arrows 48', or respectively, 56', the layer thickness of the toner particles 116 which is present on the transfer roll 42' is maintained in the transfer of the toner particles 116 onto the developer roll 54'.

FIG. 3C illustrates an enlarged view of the force field III in the development gap 110. Present on the photoconductor band 12 are: the latent charge image, regions 120 with a charge potential of −0.9 kV, and regions 122 with a reduced potential compared to the charge potential. The reduction occurs on the basis of the exposure of the photoconductor band 12 in the regions 122 in a previous exposure step. The reduced potential has a numerical value of approximately 0 V.

In the region of the development gap 110, between the regions 122 and the surface layer 52', there arises an electrical field whose lines are directed in the direction of the surface layer 52' by the surface of the photoconductor 12. Instead of the field lines, force lines 123 on the negatively charged toner particles 116 are illustrated in FIG. 3C, which force lines run in the direction from surface layer 52' to the surface of the photoconductor band 12, in regions 122 with reduced potential. Accordingly, in the case of the regions 122, due to the force field III, the toner particles 116 skip from the surface layer 52' onto the photoconductor band 12 and settle at the regions 122.

Between the regions 120 with the charge potential and the surface layer 52', an electrical field forms, whose lines run from the surface layer 52' in the direction of photoconductor band 12. The force field lines 123 of the force field III run in the development gap 110 from the regions 120 in the direction of the surface layer 52'. Thus, toner particles 116 which are situated opposite the regions 120 are not transferred onto the photoconductor band 12, but are pressed, or urged, away from this to the surface layer 52'. Photoconductor band 12 and developer roll 54' move synchronously, so that a blurring of the toner image 124 deposited onto the latent charge image is avoided.

If the transport path of the toner particles is interrupted in the region of the force field I in that the potential of the coronal wires 38' and 40' is reduced to the value of 0 V, then the toner particles that are momentarily located between the points A', B' and C' are transported further. In the activation of the force field I by a raising of the potential of the corona wires 38' and 40' to −0.8 kV, the toner particles must first travel the transport path from A' to point C' via point B'. The time for switching the developing power of the developer unit 100 is accordingly determined essentially by the transport time of the toner particles from point A' to point C'.

Figure 4:
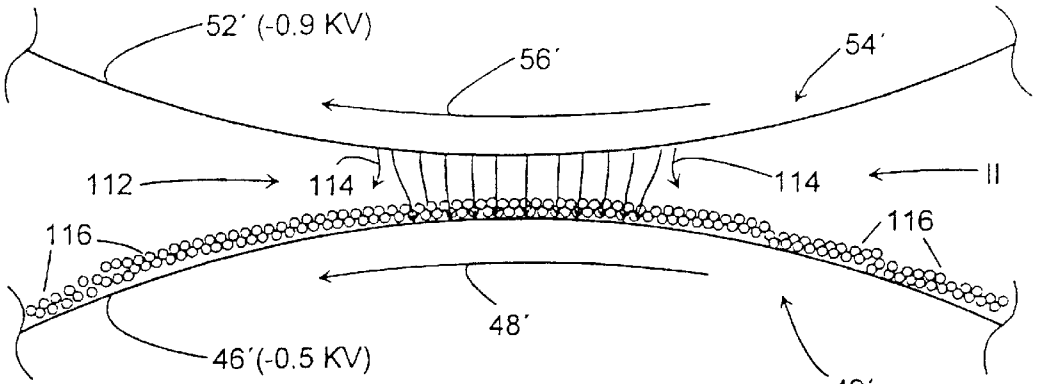
FIG. 4 is an enlarged side view showing the processes in the alteration of the force field in a transfer gap.

FIG. 4 illustrates the effect of an alteration of the force field II when, in another exemplifying embodiment, this is altered in the changeover between the transfer state and the resting state. In the activation of the resting state, the potentials on the surface layers 46' and 52' are exchanged by a control unit. The surface layer 46' thus has a potential of −0.5 kV, and the surface layer 52' has a potential of −0.9 kV. In the transfer gap 112, the field lines (not illustrated) of the electrical field now run from the surface layer 46' in the direction of the surface layer 52', so that the force lines 114 run in the opposite direction with respect to the negatively charged toner particles 116, from the surface layer 52' to the surface layer 46'. The toner particles 116 are not transferred from the transfer roll 42' to the developer roll 54' by the force field II in the resting state; rather, on the contrary, they are pressed against the surface layer 46' of the transfer roll 42' with an additional force.

Given the utilization of the force field II for the changeover between the transfer state and the resting state, the switching time is essentially determined by the transport time which the toner particles require between the points A', B' and C' (see FIG. 3A). This can be attributed to the arising, in the resting state, of a toner particle carpet on the transfer roll 42', the thickness of which deviates considerably from the required thickness in the transfer state.

In other exemplifying embodiments of the invention, the surface layers 46' and 52' have other potentials in the resting state. If the surface layer 52' has a potential of −0.9 kV in the resting state, and the surface layer 46' has a potential of 0 V, then the potential difference in the transfer gap is even greater, and it is more certain that no toner particles 116 move from the transfer roll 42' to the developer roll 54'. In this case, a toner particle carpet of the toner particles 116 develops on the transfer roll 52', the thickness of which in the resting state appreciably exceeds the thickness in the transfer state. The switching time for the changeover of the developing power is extended and is determined by the transport time from point A' via point B' to point A' (see the FIG. 3A).

In another exemplifying embodiment of the invention, in the resting state the surface 10 layer 52' has a potential of −0.3 kV and the surface layer 46' has a potential of 0 V.

Figure 5:
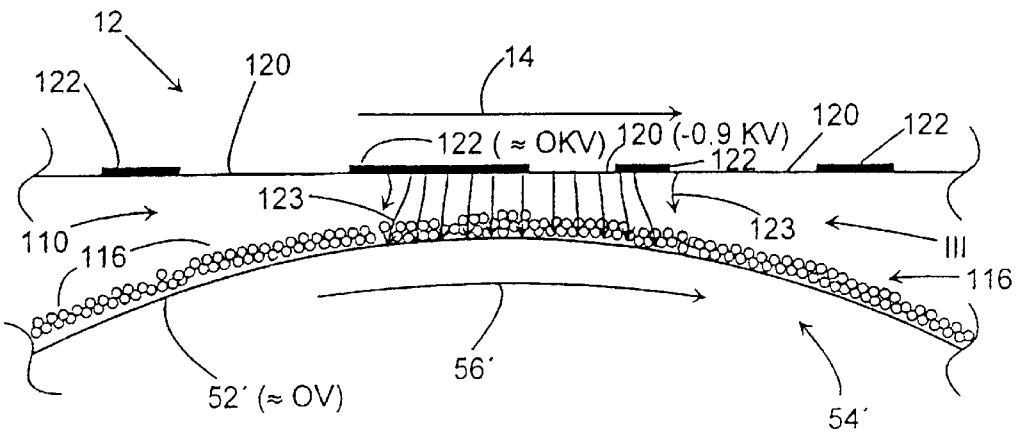
FIG. 5 is an enlarged side view showing the processes in the alteration of the force field in a development gap.

FIG. 5 illustrates an exemplifying embodiment of the invention in which the force field III is altered in the changeover between the transfer state and the resting state. In the resting state, the surface layer 52' has a potential of 0 V. As a result, the force lines of the force field III for both the regions 120 and the regions 122 are directed from the photoconductor band 12 in the direction of surface layer 52'. A settling of toner particles 116 on the photoconductor band 12 is prevented. The switching time in the changeover between the resting state and the transfer state, or respectively, from the transfer state into the resting state is very short.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for operating an electrographic printer or copier, comprising the steps of:

depositing toner particles of different colors on a toner image carrier by at least two developer units, selectively switching one of the two developer units into a transfer state in which toner particles are deposited onto the toner image carrier, providing the other of the two developer units in a resting state in which no toner particles are deposited onto the toner image carrier, in the transfer state of the developer unit, applying a force field to at least one segment of the transport path of the toner particles from a toner container to the toner image carrier, said force field effecting transport of the toner particles in a direction of the toner image carrier, and in the resting state of the developer unit, interrupting the transport of the toner particles at the at least one segment by altering of the force field, providing the force field so that it acts in one of the region of a toner particle stock contained in the toner container and in the region of a transfer gap of a transport mechanism which transports the toner particles to be applied subsequent to removal from the toner container to a development gap between the toner image carrier and a delivery element for delivering toner particles from the developer unit.

2. A method according to claim 1, further comprising the step of altering:

the force field by one of reversing a polarity and switching off an electrical supply voltage for buildup of the force field.

3. A method according to claim 1, further comprising the step of:

providing an additional force field that acts in a region of a development gap between the toner image carrier and a delivery element for delivering toner particles from the developer unit.

4. An electrographic printer or copier, comprising:

a toner image carrier onto which toner particles of different colors are deposited by at least two developer units, a control unit which selectively switches one of the two developer units into a transfer state in which toner particles are deposited onto the toner image carrier, the other of said two developer units being in a resting state in which no toner particles are deposited on the toner image carrier, at least one field generator for each of said two developer units which generate a force field which acts on a segment of the transport path of the toner particles from the toner container to the toner image carrier, the control unit being connected to switch the force field in the transfer state such that the force field effects the transport of the toner particles in the direction of the toner image carrier, and in the resting state, the control unit being operable to switch the force field such that the transport of the toner particles is interrupted at the segment, at least one of the two developer units includes the following elements:

a device for creating a mixture of air and toner particles in the toner container, which mixture behaves like a fluid, a corona device with a predetermined potential for the electrical charging of the toner particles, and at least one of a toner accepting surface arranged opposite the corona device and onto which the charged toner particles settle under influence of the force field and at least one of the two developer units including a transport device for transporting the charged toner particles, said transport device transporting the charged toner particles subsequent to removal from the toner container in the direction of a delivery for delivering the toner particles from the developer unit, and the force field is being arranged inside the transport device.

5. An electrographic printer or copier according to claim 4, further comprising:

at least one rotating surface which rotates with a prescribed speed in the transfer state and in the resting state on which the toner particles are transported.

6. An electrographic printer or copier according to claim 4, wherein the force field is generated between opposed conductive surfaces or surface portions that have a potential difference of a specified size, said potential difference being at least one of reduced and altered in its sign in the resting state as compared to the operative state.

* * * * *